US010978829B2

(12) United States Patent
Wimmer et al.

(10) Patent No.: US 10,978,829 B2
(45) Date of Patent: Apr. 13, 2021

(54) ELECTRICAL CONNECTOR AND CONNECTION

(71) Applicant: Lisa Dräxlmaier GmbH, Vilsbiburg (DE)

(72) Inventors: Stefan Wimmer, Türkenfeld (DE); Martin Allersdorfer, Gundolfstraße (DE)

(73) Assignee: LISA DRAEXLMAIER GMBH, Vilsbiburg (DE)

( * ) Notice: Subject to any disclaimer, the term of this patent is extended or adjusted under 35 U.S.C. 154(b) by 0 days.

(21) Appl. No.: 16/594,823

(22) PCT Filed: Apr. 4, 2018

(86) PCT No.: PCT/DE2018/200033
§ 371 (c)(1),
(2) Date: Oct. 7, 2019

(87) PCT Pub. No.: WO2018/184641
PCT Pub. Date: Oct. 11, 2018

(65) Prior Publication Data

US 2020/0059041 A1 Feb. 20, 2020

(30) Foreign Application Priority Data

Apr. 6, 2017 (DE) ..... 102017107410.4

(51) Int. Cl.
*H01R 13/639* (2006.01)
*H01R 13/193* (2006.01)
(Continued)

(52) U.S. Cl.
CPC ..... *H01R 13/639* (2013.01); *H01R 13/193* (2013.01); *H01R 13/506* (2013.01); *H01R 13/6272* (2013.01)

(58) Field of Classification Search
CPC .. H01R 13/639; H01R 13/193; H01R 13/506; H01R 13/6272
See application file for complete search history.

(56) References Cited

U.S. PATENT DOCUMENTS 4,973,271 A 11/1990 Ishizuka et al.
5,941,737 A * 8/1999 Sakai ..... H01R 13/4223 439/752

(Continued)

FOREIGN PATENT DOCUMENTS

DE 2707122 A1 9/1977
DE 102009057688 A1 6/2011

(Continued)

OTHER PUBLICATIONS

International Search Report for corresponding Application No. PCT/DE2018/200033 dated Jun. 27, 2018 (4 pages).

(Continued)

*Primary Examiner* — Gary F Paumen
(74) *Attorney, Agent, or Firm* — Jacob Eisenberg; BelayIP

(57) ABSTRACT

An electrical connector may be provided for connection to a mating electrical contact in an insertion direction. The connector has an inner casing in which an electrical bushing contact having a locking element, which can be moved parallel to the insertion direction for setting a contact force, can be fixed to the mating contact, which can be inserted into the bushing contact. At least one axial end of the locking element may protrude laterally out of the inner casing. The connector also has an outer casing in which the inner casing can be accommodated. A locking element fixing means, which can be fixed on the outer casing in a stationary manner against movement parallel to the insertion direction and also engages in the axial end of the locking element, is also (Continued)

provided, allowing a movement of the inner casing relative to the outer casing parallel to the insertion direction.

13 Claims, 6 Drawing Sheets

(51) Int. Cl.
*H01R 13/506* (2006.01)
*H01R 13/627* (2006.01)

(56) References Cited

U.S. PATENT DOCUMENTS

| | | | | |
|---|---|---|---|---|
| 7,351,117 | B1 * | 4/2008 | Mostoller | H01R 13/428 439/744 |
| 8,840,435 | B2 * | 9/2014 | Plazio | H01R 13/506 439/701 |
| 9,287,650 | B2 * | 3/2016 | Wimmer | H01R 13/428 |
| 9,531,105 | B2 * | 12/2016 | Wimmer | H01R 13/4362 |
| 9,640,905 | B2 * | 5/2017 | Suzuki | H01R 13/64 |
| 9,735,504 | B2 | 8/2017 | Wimmer | |

FOREIGN PATENT DOCUMENTS

| | | | |
|---|---|---|---|
| DE | 102013205447 | A1 | 10/2014 |
| DE | 10 2015 104 377 | A1 | 9/2016 |
| DE | 10 2015 114 080 | A1 | 3/2017 |
| DE | 10 2016 105 497 | B3 | 8/2017 |
| DE | 10 2016 105 504 | A1 | 9/2017 |
| EP | 3 073 577 | A1 | 4/1992 |

OTHER PUBLICATIONS

Office Action of corresponding German Patent Application No. 10 2017 107 410.4 dated Dec. 8, 2017 (6 pages).
Office Action of corresponding German Patent Application No. 10 2017 107 410.4 dated Jun. 15, 2018 (6 pages).
Translation of DE2707122 (A1).
Translation of DE102009057688 (A1).
Translation of DE102013205447 (A1).

* cited by examiner

ELECTRICAL CONNECTOR AND CONNECTION

CROSS REFERENCE TO RELATED APPLICATIONS

This application is a national phase application of International Application No. PCT/DE2018/200033, filed Apr. 4, 2018, and claims the priority of German Application No. 10 2017 107 410.4, filed Apr. 6, 2017, the content of both of which is incorporated herein by reference.

FIELD

The present disclosure relates to an electrical insertion-type connector, which is suitable in particular for insertion-type connections in a motor vehicle. Furthermore, the disclosure also relates to an insertion-type connection which can formed between such an insertion-type connector and a header or mating insertion-type contact.

BACKGROUND

Some connections and insertion-type connectors for use in a motor vehicle are already known. One such insertion-type connector, for the electrical connection, has an electrical bushing contact, of the kind described for instance in DE 10 2015 104 377 A1 or DE 10 2015 114 080 A1. This bushing contact is suitable in particular for use in a high-voltage on-board electrical system and for conducting relatively high voltage.

Furthermore, from DE 10 2016 105 504 A1 or DE 10 2016 105 497, insertion-type connectors with casings are known in which once again the above-described bushing contact is employed. It has been found that such an insertion-type connector, or its casing, because of the structural design of the bushing contact (e.g., with a locking element that is movable in the insertion direction), makes sealing off the insertion-type connector in the vicinity of the locking element more difficult. This may be because to apply a sufficient contacting force of the bushing contact to a mating insertion-type contact inserted into it, a motion of the locking element in the insertion direction of the insertion-type connector is necessary. Therefore in the aforementioned documents it is proposed that the casing of the connector be located inside a separate shielding casing and to seal that casing off, but this requires additional construction space or necessitates additional shielding casing.

SUMMARY

In view of the above limitations of the related art, an object of certain embodiments of the disclosure may therefore be, for example, to create an insertion-type connector with a bushing contact the locking element of which can be actuated in such a way that a casing of the insertion-type connector can be sealed off simply using structurally the simplest possible means.

The above and other objects may be attained by implementations consistent with the independent claims. Advantageous refinements of the disclosure may be recited in the dependent claims, the specification, and the accompanying drawings. Objects and advantages of the disclosed embodiments may be realized and attained by the elements and combinations set forth in the claims. However, embodiments of the present disclosure are not necessarily required to achieve such exemplary objects and advantages, and some embodiments may not achieve any of the stated objects and advantages.

An electrical insertion-type connector according to the disclosure may be suitable for embodying a insertion-type connection by being inserted into an electrical mating insertion-type contact that is preferably located in a header casing, in an insertion direction. An insertion-type connection may include a plug-and-socket type connection. The insertion direction hereinafter always refers to the insertion-type connector, but not to the mating insertion-type contact, which is thus put together with the insertion-type connector counter to the insertion direction. For example, the insertion direction may refer to a reference frame of a plug of the plug-and-socket type connection, rather than a socket. Insertion "in" the insertion direction may mean that an element advances along a specified direction, e.g., in the direction that arrow S points (see FIG. 1), while insertion "counter" to the insertion direction may mean that an element advances in a reverse direction to the specified direction, e.g., 180 degrees from the direction that arrow S points. It will be understood that gender of a connection may be reversed. The insertion-type connector has an insertion-type connector casing with an inner casing and an outer casing, which are preferably fitted in such that they can be inserted into one another and moved relative to one another. An electrical bushing contact with a locking element that is movable parallel to the insertion direction and counter to it can be received in the inner casing for adjusting a contact force on the mating insertion-type contact that is insertable into the bushing contact and is fixable or is fixed in the installed state or the put-together state in such a way that at least one axial end of the locking element protrudes laterally from the inner casing perpendicular to the insertion direction. Thus the bushing contact is fixed against moving parallel to the insertion direction and is therefore fixed in stationary fashion on the inner casing. The inner casing then can be or is received in the outer casing in the installed state, for example by putting the two casing parts one into the other, preferably in the insertion direction or parallel to it. For actuating the locking element of the bushing contact, the insertion-type connector has a locking element fixing means, which is fixable in stationary fashion on the outer casing in the insertion direction or is fixed in the installed state and furthermore engages the axial end of the locking element and in so doing, however, allows a motion of the inner casing relative to the outer casing parallel to the insertion direction, and in particular in the insertion direction. Viewed in functional terms, the locking element fixing means is both fixedly and immovably connected to the outer casing and simultaneously engages a locking bolt, so that a motion of the outer casing relative to the inner casing or vice versa also causes a motion of the locking element relative to the outer casing; this locking element is connected to the outer casing via the locking element fixing means. In other words, the locking element fixing means, upon a motion of the outer casing, carries the locking element along with it. In this way, the locking element can be put into its locking position, in which the bushing contact imposes a contacting force on the inserted mating insertion-type contact.

With this configuration, some embodiments of the disclosure may advantageously make it possible for the insertion-type connector to be unproblematically sealed off, since the locking element of the bushing contact need not be actuated via a mechanism that protrudes into the casing from outside and as a result makes sealing off of the casing more difficult. Instead, the locking element can be actuated by means of the locking element fixing means which is needed anyway, while the locking element fixing means is located inside the casing anyway.

An especially advantageous refinement of some embodiments of the disclosure provides that the locking element fixing means is embodied as substantially U-shaped, with two opposed retaining arms, of which at least one has an engagement groove shaped to be perpendicular to the insertion direction (S) for making it engage the axial end of the locking element. The locking element can be embodied as a locking bolt, so that the engagement groove can be arranged for receiving a circular locking element. Preferably, the width to which the retaining arms open is slightly wider than the outer width of the inner casing and of a portion of the outer casing. The locking element fixing means is fixed in stationary fashion on the outer casing and by its engagement also fixes the locking element relative to the outer casing, so that the outer casing, the locking element fixing means, and the locking element form a common block, and the inner casing remains movable relative to the outer casing.

In some embodiments, to further enhance simplicity of assembly of the insertion-type connector, the engagement groove can be embodied between a first retaining arm portion and a second retaining arm portion; then, the second retaining arm portion, facing away from the mating insertion-type contact, is shorter in the insertion direction than the first retaining arm portion. Thus the locking element fixing means can already be fixed or pre-fixed on the outer casing without hindering the insertion of the bushing contact or of the inner casing with the bushing contact, since the bushing contact can be moved past the second retaining arm portion in the insertion direction.

For fixation of the locking element fixing means on the outer casing, it may be advantageous if the retaining arms, on a side toward the inner casing, have a detent element, which can be put into engagement with at least one mating detent element of the outer casing. Thus the locking element fixing means can be pre-fixed or fixed by means of a clip connection, which can also be done without a tool.

For fixation of the locking element fixing means, the outer casing can have a locking element fixing means guide, in which the locking element fixing means, for simpler assembly, is guided perpendicular to the insertion direction and is fixed in and counter to the insertion direction. Furthermore, the locking element fixing means can be thrust, perpendicular to the insertion direction, onto a portion of the outer casing and fixed parallel to the insertion direction, since the locking element fixing means is present at the locking element fixing means guide. In particular, face ends of the locking element fixing means or of the retaining arms rest against mating faces of the locking element fixing means guide and thus embody an interlocking fixation.

For the initial fixation and final fixation of the locking element fixing means, the outer casing can have at least one first mating detent element, associated with a pre-detent position of the locking element fixing means, and at least one second mating detent element, spaced apart perpendicular from the first mating detent element perpendicular to the insertion direction and associated with a final detent position of the locking element fixing means, for entering into engagement with the locking element fixing means as needed. In particular, it is possible for the mating detent elements to be embodied in the locking element fixing means guide, so that the locking element fixing means is automatically guided into the two detent positions and for that purpose requires only a motion of the locking element fixing means perpendicular to the insertion direction.

Alternatively to this, the locking element fixing means can have two detent elements, spaced apart from one another perpendicular to the insertion direction, and can catch onto each detent element on a single mating element of the outer casing.

To enhance simplicity of assembly, in the pre-detent position of the locking element fixing means, the locking element of the bushing contact can be movable in the insertion direction on the free end of the second retaining arm portion and can be brought into engagement with the first retaining arm portion. In the pre-detent position, the locking element fixing means is no longer in the form of a separate component; instead, it is already (pre-) fixed onto the outer casing. Nevertheless, the bushing contact can still be inserted into the outer casing parallel to or in the insertion direction; the locking element fixing means forms a stop for the bushing contact in the insertion direction, so that the bushing contact can be inserted only as far as an intended stop point.

In some embodiments, an assembly can be improved or simplified still further if in the final detent position of the locking element fixing means, both retaining arm portions are in engagement with the locking element. Thus if the locking element fixing means has been moved from the pre-detent position to the final detent position, the locking element of the bushing contact is fixed in both directions, parallel to the insertion direction. In addition to the stop in the insertion direction, a stop counter to the insertion direction is thus additionally achieved. By means of a simple motion of the locking element fixing means perpendicular to the insertion direction from the pre-detent position to the final detent position, a full fixation of the bushing contact or of its locking element can thus be achieved.

To enable especially good sealing and good mechanical protection for the bushing contact, the outer casing can have an inner casing receptacle part and a header casing receptacle part surrounding it on the outside perpendicular to the insertion direction. In the radial direction or circumferential direction of the insertion-type connector, the outer casing thus has parts nested in one another, and the inner casing can be put into one part in the insertion direction, and the header casing can be put into another part counter to the insertion direction Preferably, the locking element fixing means is located in the header casing receptacle part and thus surrounds the inner casing and the inner casing receptacle part. As a result, the inner casing can also move relative to the outer casing and to the locking element fixing means.

For actuating the locking element, by way of which element the bushing contact exerts the contacting force against the mating insertion-type contact, the outer casing can have a fastener slide, which is guided displaceably on the outer casing perpendicular to the insertion direction. For that purpose, a fastener slide guide can be provided on an outer side of the outer casing, which guide guides the fastener slide perpendicular to the insertion direction. Furthermore, the fastener slide can be made to engage a header casing of the mating insertion-type contact. In addition, upon actuation of the fastener slide, the outer casing can be moved relative to the inner casing or vice versa, namely via a guide link, embodied on the fastener slide, that is engaged by the header casing.

The disclosure also relates to an electrical insertion-type connector, which is particularly suitable for use in an on-board electrical system of a motor vehicle. The insertion-type connection has an electrical insertion-type connector, described above, and an electrical mating insertion-type contact that can be put together with it or which in the built-in state is put together with it, which mating insertion-type contact is located in a header casing. Ideally, the outer casing and the header casing can be inserted into one another in the insertion direction or parallel to it; the inner casing of the insertion-type connector remains movable until the installation is complete, so that the locking element of the bushing contact of the insertion-type connector can be put in a locking position.

For actuating or closing the insertion-type connector, a fastener slide of the insertion-type connector can be made to engage the header casing. A closing motion of the fastener slide perpendicular to the insertion direction effects a relative motion between the inner casing and the outer casing of the insertion-type connector in or parallel to the insertion direction.

BRIEF DESCRIPTION OF THE DRAWINGS

The above and other aspects of the present disclosure will become more apparent by describing exemplary embodiments in detail below with reference to the accompanying drawings. Below, one advantageous exemplary embodiment of the invention is explained with reference to the drawings. These show.

The drawings are merely schematic illustrations and serve solely to explain some exemplary embodiments of the disclosure. Identical elements or elements with the same effect are all identified by the same reference numerals.

DETAILED DESCRIPTION

As used throughout the present disclosure, unless specifically stated otherwise, the term "or" encompasses all possible combinations, except where infeasible. For example, the expression "A or B" shall mean A alone, B alone, or A and B together. If it is stated that a component includes "A, B, or C," then, unless specifically stated otherwise or infeasible, the component may include A, or B, or C, or A and B, or A and C, or B and C, or A and B and C. Expressions such as "at least one of" do not necessarily modify an entirety of a following list and do not necessarily modify each member of the list, such that "at least one of A, B, and C" should be understood as including only one of A, only one of B, only one of C, or any combination of A, B, and C.

Figure 1:
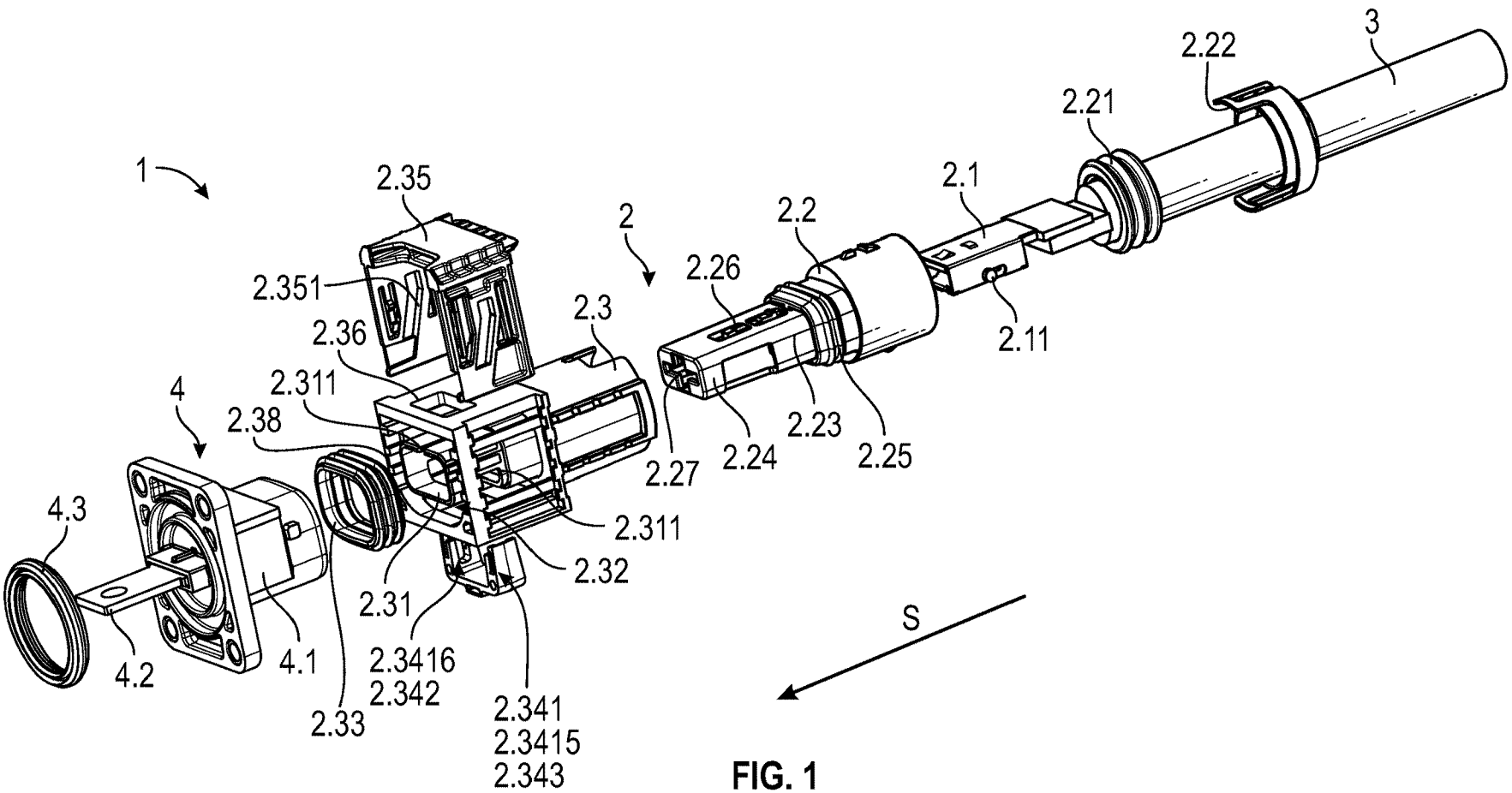
FIG. 1 an exploded view in perspective of an insertion-type connection of the disclosure, which is formed by the electrical insertion-type connector of the disclosure and a header with a mating insertion-type contact.

FIG. 1, in a perspective exploded view, shows an electrical insertion-type connection 1, which essentially consists of an electrical insertion-type connector 2 as the first contact partner, an electric lead 3 connected to it, and a header 4, as the second contact partner, that can be put together with the insertion-type connector 2. Hereinafter, a uniform designation assumes that the putting together is done such that the insertion-type connector 2 is put together with the header 4 in an insertion direction S. The insertion-type connection 1 is especially advantageously suitable for use in a motor vehicle.

The insertion-type connector 2 has an electrical bushing contact 2.1, of the kind explained in detail in the prior art mentioned at the outset, DE 10 2015 104 377 A1 or DE 10 2015 114 080 A1, which are incorporated here by reference. Accordingly, the bushing contact 2.1 has a bushing (not identified by reference numeral), a contact spring (not identified by reference numeral), a locking element 2.11 in the form of a locking bolt, and a flat contact cord (not identified by reference numeral). The contact cord is connected electrically to the lead 3. The locking element 2.11 is displaceable, parallel to the insertion direction S, in a guide formed by slits in the bushing; as a result, a contacting force inside the bushing of the bushing contact 2.1 can be adjusted. The locking element 2.11, for that purpose, is movable smoothly, parallel to the insertion direction S, between an unlocking position, in which the bushing contact 2.1 exerts either only a slight contact force or none, and a locking position, in which the bushing contact 2.1 exerts a contact force in the form for instance of a clamping force.

The bushing contact 2.1 is received in an electrically insulating inner casing 2.2, manufactured of a plastic, which inner casing, on an end facing toward the lead 3 is sealed off with a first sealing element 2.21 in the form of a ring seal and closed with a cap 2.22. The first sealing element 2.21 and the cap 2.22 in the longitudinal direction form the closure of the insertion-type connection 1. It can be seen in FIG. 1 that the bushing contact 2.1 is received in a bushing contact receptacle 2.23 of the inner casing 2.2 and is primarily locked there; the bushing contact receptacle 2.23, perpendicular to the insertion direction S, has two slitlike openings 2.24 in the form of recesses in material, in order to be able to guide the axial ends of the locking element 2.11 out of the inner casing 2.2. Because of the slitlike design of the openings 2.24, in which the slits run parallel to the insertion direction S, the locking element 2.11 can be moved back and forth completely between its unlocking and locking positions. For sealing purposes, a second sealing element 2.25 is located, adjacent to the bushing contact receptacle 2.23, on a collar of the inner casing 2.2.

The inner casing 2.2 is received in an electrically insulating outer casing 2.3, likewise made from plastic, which can be inserted into each other parallel to the insertion direction; the second sealing element 2.25 then comes into contact with an inner side of the outer casing 2.3. The outer casing 2.3 furthermore has both an inner casing receptacle part 2.31, with corresponding lateral openings 2.311, 2.312 for leading the axial ends of the locking element 2.11 to the outside, and a header casing receptacle part 2.32, surrounding it on the outside perpendicular to the insertion direction, which are accessible from opposed directions extending parallel to the insertion direction S. In the inner casing receptacle part 2.31, the bushing contact receptacle 2.23 of the inner casing 2.2 is received along with the bushing contact 2.1 by being plugged into each other in the insertion direction S, and seals off this portion by means of the second sealing element 2.24, resting behind the bushing contact 2.1 on the inside of the outer casing 2.3. The header 4 is received in the header casing receptacle part 2.32 by being put together counter to the insertion direction S, and seals off this portion by means of a third sealing element 2.33 in the form of a ring seal, which rests on the inside on the outer casing 2.3 and on the outside of the header 4. The outer casing 2.3 furthermore has a separately manufactured locking element fixation 2.34. Locking element fixation 2.34 may include means for fixing. Locking element fixation 2.34 may be fixed to outer casing 2.3 in stationary fashion, and at least parallel to the insertion direction S. Furthermore, the outer casing 2.3 has a fastener slide 2.35, which cooperates with the header 4 in order to fix the header 4 and the outer casing 2.3 to one another in the assembled state.

The header 4 has an electrically insulating header casing 4.1 of a plastic, in which casing an electrical mating insertion-type contact 4.2 in the form of a flat insertion-type contact is inserted and protrudes parallel to the insertion direction S. The mating insertion-type contact 4.2 in the assembled state, that is, the installed state, is inserted into the bushing of the bushing contact 2.1 and, in the locking position of the locking element 2.11, contacted and fixed by means of the contact force. On a securing flange (not identified by reference numeral) of the header casing 4.1, a fourth sealing element 4.3 is located, which longitudinally forms a further closure of the insertion-type connection 1. Because there are a total of four sealing elements 2.21, 2.24, 2.33 and 4.3, the insertion-type connection 1 is well sealed off.

Figure 2:
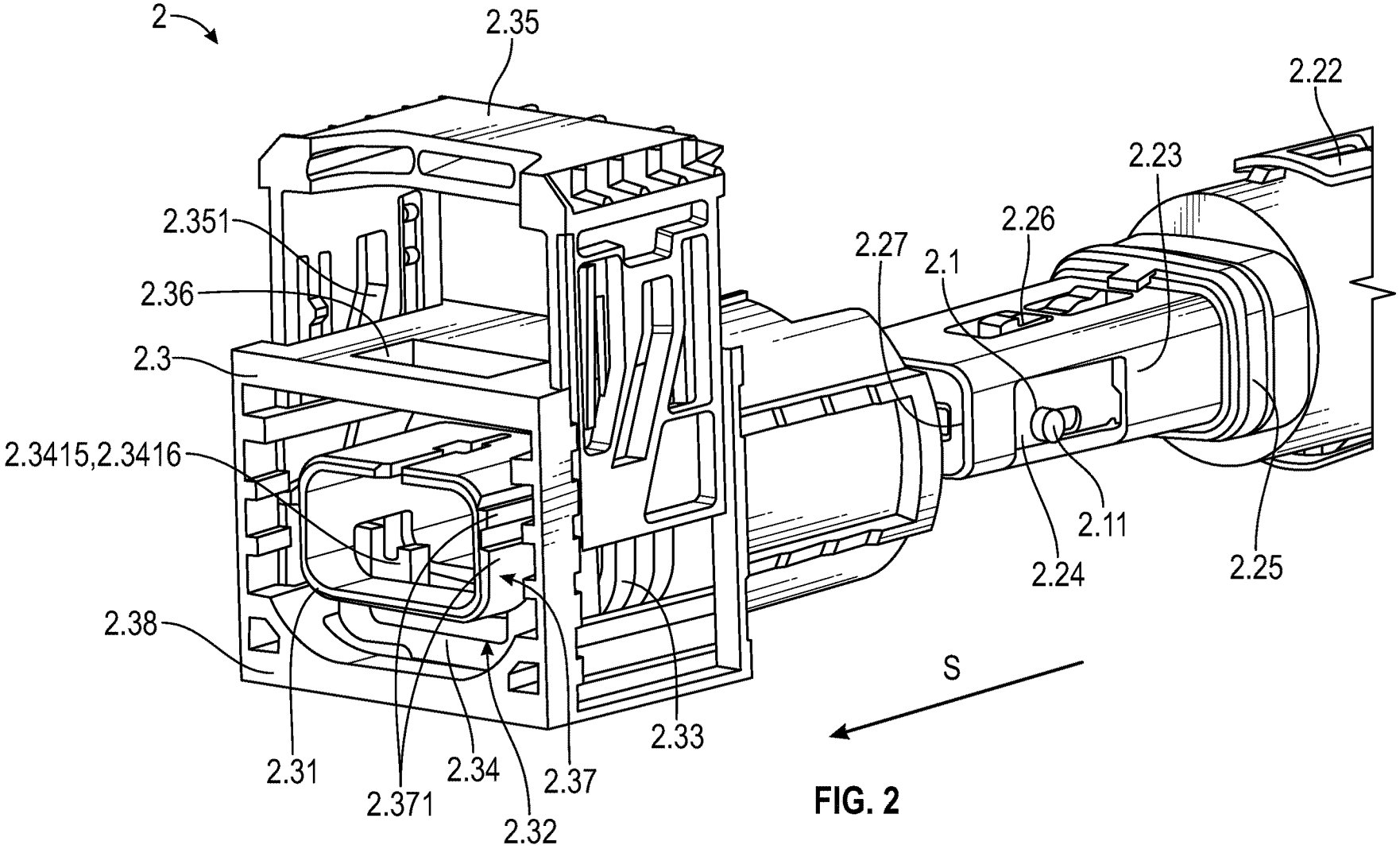
FIG. 2 in a perspective view, a portion of the insertion-type connector with an inner casing and an outer casing, before they are inserted into one another.

In FIG. 2, the insertion-type connector 2 is shown again in detailed fashion in a perspective view, in which the inner casing 2.2 together with the bushing contact 2.1 has not yet been inserted into the outer casing 2.3. It can therefore be seen that the locking element fixing means 2.34 is guided in a locking element fixing means guide 2.37 of the outer casing 2.3, and this guide is shaped between the inner casing receptacle part 2.31 and the header casing receptacle part 2.32. The locking element fixing means 2.34 is U-shaped, with two retaining arms 2.341, 2.342 that are complementary to one another and that are connected to one another via a base part 2.343. Each of the retaining arms 2.341, 2.342 has two retaining arm portions 2.3411, 2.3412 and 2.3413, 2.3414, respectively, adjacent to one another in the insertion direction S, of which the one that is forward in the insertion direction S (that is, is to the right in FIG. 2) is shorter in a direction perpendicular to the insertion direction S than the other. Between the respective retaining arm portions 2.3411, 2.3412 and 2.3413, 2.3414, a central engagement groove 2.3415 and 2.3416, respectively, is formed in each of the retaining arms 2.341, 2.342 perpendicularly to the insertion direction S, and the axial ends of the locking element 2.11 engage them if on the one hand the inner casing 2.2 is inserted into the outer casing 2.3 and lock there and on the other the locking element fixing means 2.34 is in its final detent position (see FIG. 4). The engagement groove 2.3415 and 2.3416, respectively, is open only toward the interior of the U shape and toward the outside is covered by plastic material of the respective retaining arm 2.341, 2.342. Engagement grooves may include detent elements. Each of the retaining arms 2.341, 2.342, for being secured to the outer casing 2.3, has two detent elements oriented inward (that is, into the U shape): a first detent element, which may include engagement groove 2.3415, 2.3416, and a second detent element 2.3417, 2.3418, respectively, which are spaced apart from one another in a direction that is perpendicular to the insertion direction S. Each first detent element (e.g., engagement groove 2.3415, 2.3416) of the pre-detent position (see FIG. 2) and each second detent element 2.3417, 2.3418 of the final detent position (see FIG. 4) is associated with the locking element fixing means 2.34. The detent elements or engagement grooves 2.3415, 2.3416 and 2.3417, 2.3418, respectively, are each capable of being brought into engagement with a mating detent element 2.371 of the locking element fixing means guide 2.37 of the outer casing 2.3, and the final detent position, out of the pre-detent position, is attained in such a way that the locking element fixing means is moved farther in the same direction (see movement direction B in FIG. 4), past the pre-detent position, until the final detent position is reached by engagement of the second detent element 2.3417, 2.3418. In and counter to the insertion direction S, the locking element fixing means 2.34 is fixed by means of contact on both sides with the locking element fixing means guide 2.37.

Furthermore, it can be seen from FIG. 2 that the locking element fixing means 2.34 and the fastener slide 2.35 are actuated in directions opposite, or in other words contrary, to one another, both of which are oriented perpendicular to the insertion direction S. The locking element fixing means 2.34 and the fastener slide 2.35 are here each located in a pre-detent position, in which they are held by a suitable detent means on the outer casing 2.3. It can also be seen that the third sealing element 2.33 is located between the inner casing receptacle part 2.31 and the header casing receptacle part 2.32, or in other words in the interior of the outer casing 2.3. In terms of the insertion direction S, the third sealing element 2.33 is thus located in front of the bushing contact 2.1 in the assembled state.

It can further be seen from FIG. 2 that the inner casing 2.2, on a side (in FIG. 2, the upper side) offset by 90° from the lateral openings 2.24, has a locking rocker 2.26, of which at least one free end can be deflected outward perpendicular to the insertion direction S. Furthermore, the locking rocker 2.26, in its non-outwardly-deflected state, is in engagement with a locking opening 2.36 of the outer casing 2.3, as long as the inner casing 2.2 and the outer casing 2.3 are plugged into one another. Because of the engagement between the locking rocker 2.26 and the locking opening 2.36, the outer casing 2.3 and the inner casing 2.2 are not movable relative to one another.

Figure 3:
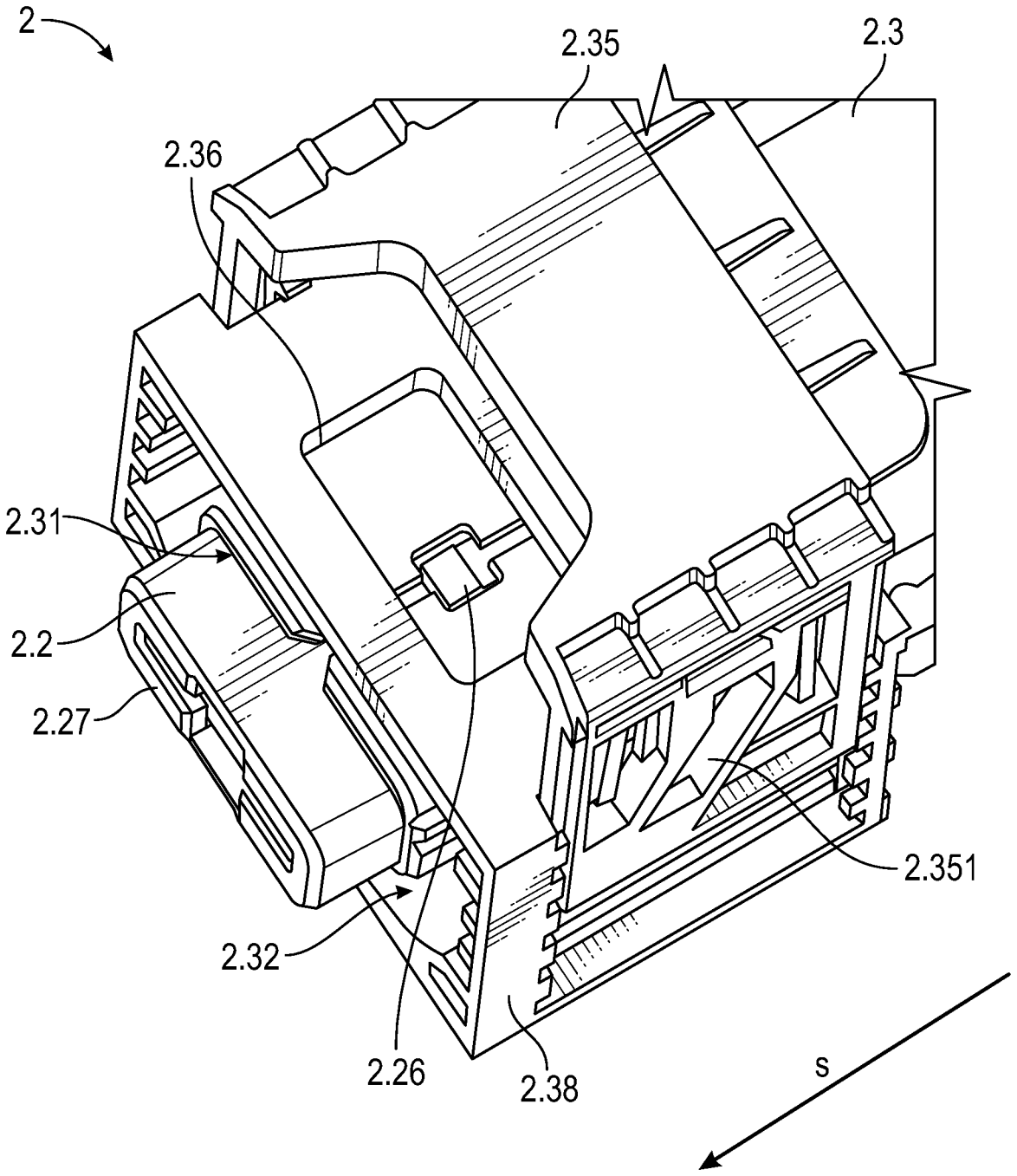
FIG. 3 a top view in perspective on the portion of the insertion-type connector in which the inner casing is connected to the outer casing via a locking rocker.

This can be seen even better in FIG. 3, in which the inner casing 2.2 is already inserted into the outer casing 2.3. Accordingly, the locking rocker 2.26 is in engagement with the locking opening 2.36, so that the inner casing 2.2 and the outer casing 2.3 are fixed against a relative motion to one another. In this pre-assembled state of the insertion-type connector 2, the inner plug face 2.27 of the inner casing 2.2 protrudes in the insertion direction S past the outer plug face 2.38. Viewing this together with FIG. 1 or FIG. 2, it can be seen that the locking element 2.11 of the bushing contact 2.1 is in its locking position, in which the mating insertion-type contact 4.2 of the header 4 cannot (yet) be introduced into the bushing contact 2.1, since the bushing itself is locked.

Figure 4:
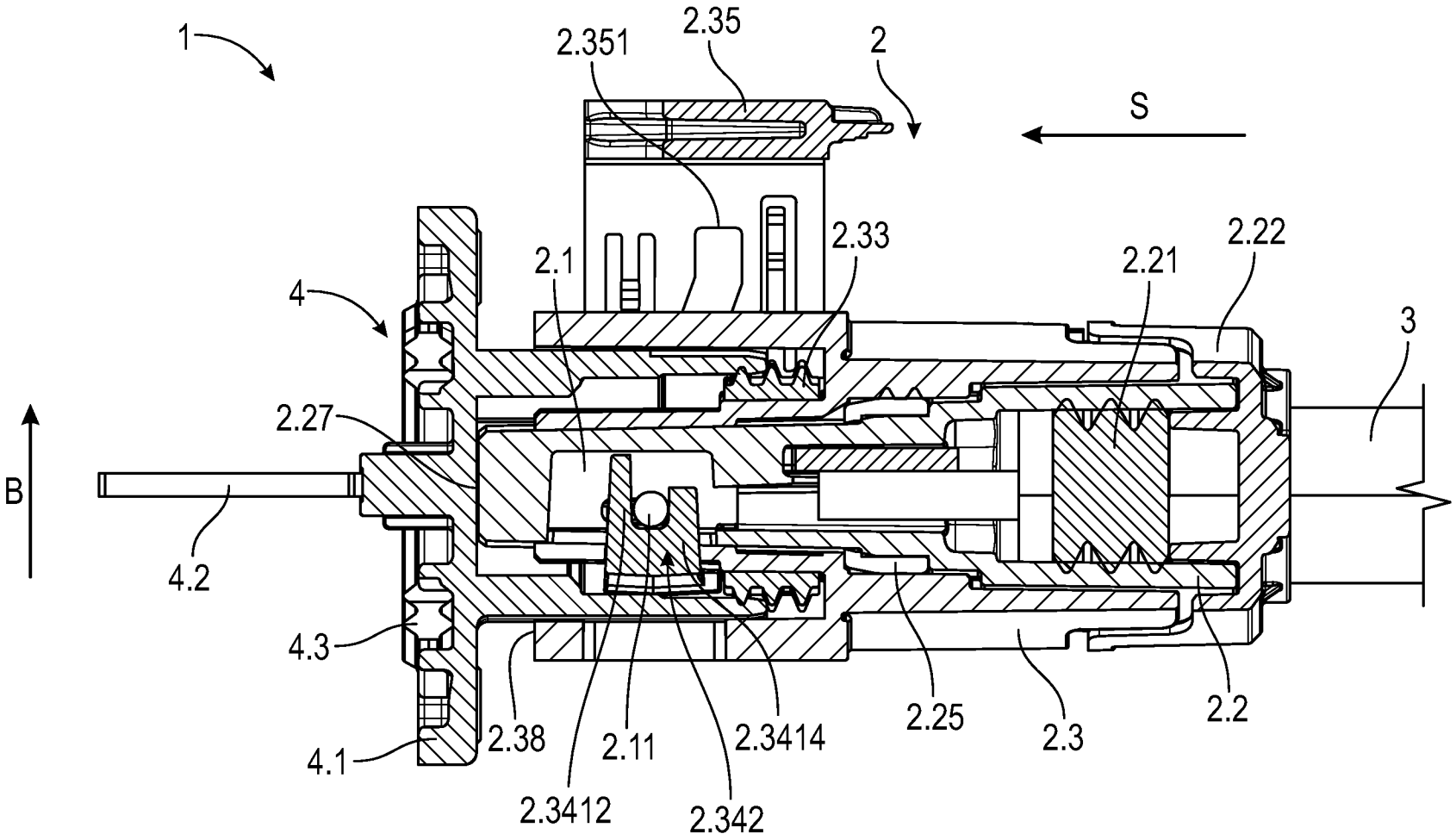
FIG. 4 a sectional view of the portion of the insertion-type connection in which a locking element fixing means is in a final detent position.

FIG. 4 shows a sectional view of a portion of the insertion-type connection 1, in which the inner casing 2.2 together with the bushing contact 2.1 and the outer casing 2.3 of the insertion-type connector 2 are inserted into one another, and the insertion-type connector 2 is (not yet all the way) inserted into the header 4. The inner plug face 2.27 furthermore protrudes past the outer plug face 2.38, so that the bushing contact 2.1 is in its unlocking position, and the mating insertion-type contact 4.2 can be inserted and later locked. However, the locking element fixing means 2.34 is in its final detent position, which can be seen particularly from the fact that the axial ends of the locking element 2.11 are located between two retaining arm portions 2.3411, 2.3412, and 2.3413, 2.3414, respectively, in the respective engagement groove 2.3415 and 2.3416. In other words, compared to the pre-detent position shown in FIG. 2, the locking element fixing means 2.34 has been moved in the movement direction B, as a result of which an undercut is achieved, counter to the insertion direction S, between the respective shorter retaining arm portion 2.3412, 2.3414 and the locking element 2.11. In the final detent position of the locking element fixing means 2.34, the locking element 2.11 is thus fixed both in and counter to the insertion direction S by means of engagement with the locking element fixing means 2.34, namely in particular with respective to the outer casing 2.3.

Figure 5:
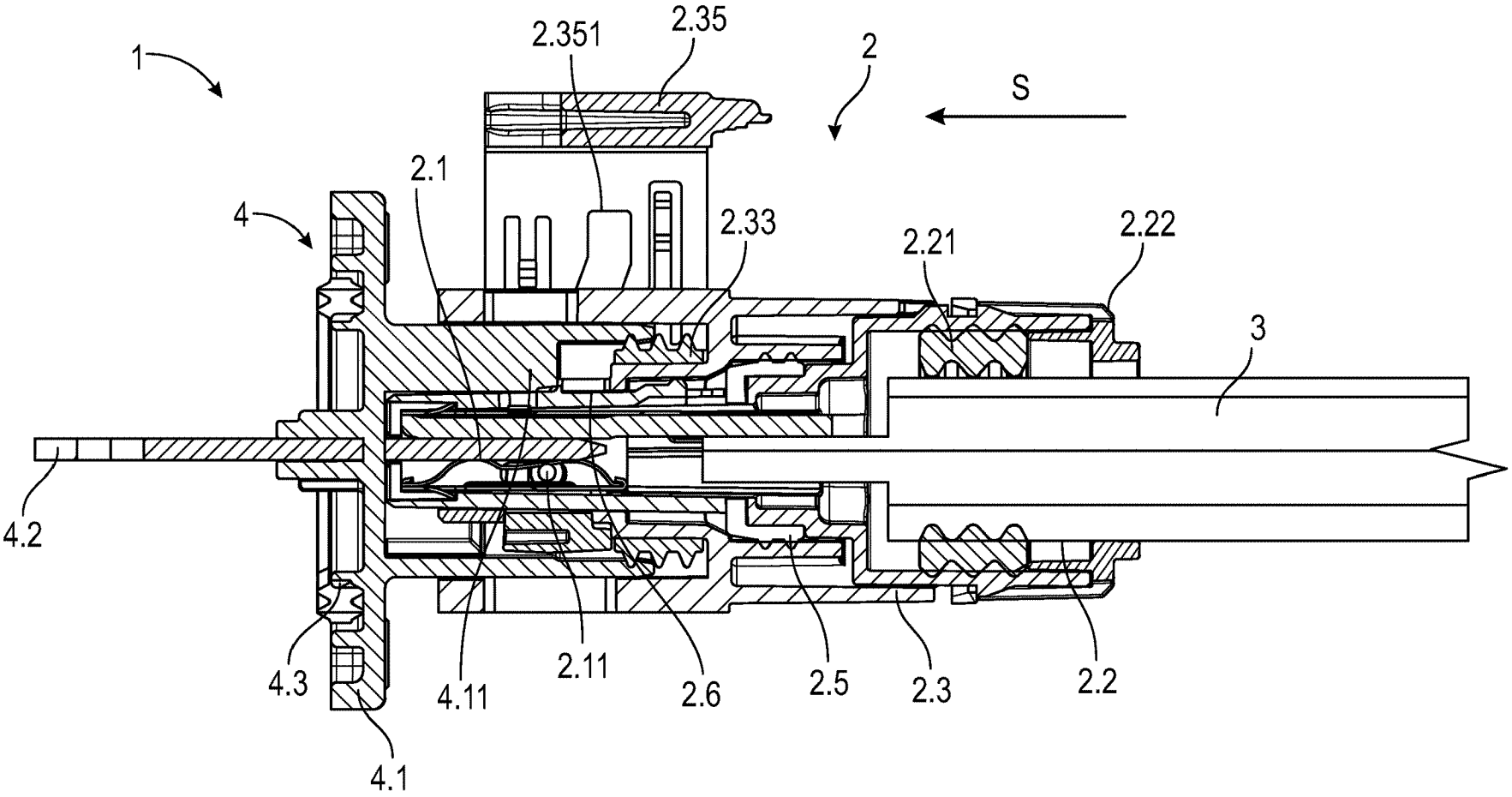
FIG. 5 a sectional view of a portion of the insertion-type connection in which the inner casing is unlocked relative to the outer casing and thus is movable relative to it.

In FIG. 5, which shows a sectional view of a portion of the insertion-type connection 1 in a sectional plane offset relative to FIG. 4, it can be seen that the header casing 4.1 has an unlocking rib 4.11, shaped toward the inside, which when the insertion-type connector 2 is put together with the header 4 in the insertion direction S comes into contact with the locking rocker 2.26, which is in engagement with the locking opening 2.36 and deflects it in such a way as to disengage it. In other words, when the insertion-type connector 2 and header 4 are inserted into one another, the locking or fixation between the inner casing 2.2 and the outer casing 2.3 is undone, and these elements can move relative to one another. In FIG. 5, it can also be seen that as a result of the motion of the inner casing 2.2 relative to the outer casing 2.3 and consequently of the locking element fixing means 2.34, the locking element 2.11 of the bushing contact 2.1 is now in its locking position, and therefore the mating insertion-type contact 4.2 is now held fixedly. When the inner casing 2.2 is unlocked relative to the outer casing 2.3, the fastener slide 2.35 is also unlocked relative to the outer casing 2.3 and can be displaced accordingly.

Figure 6:
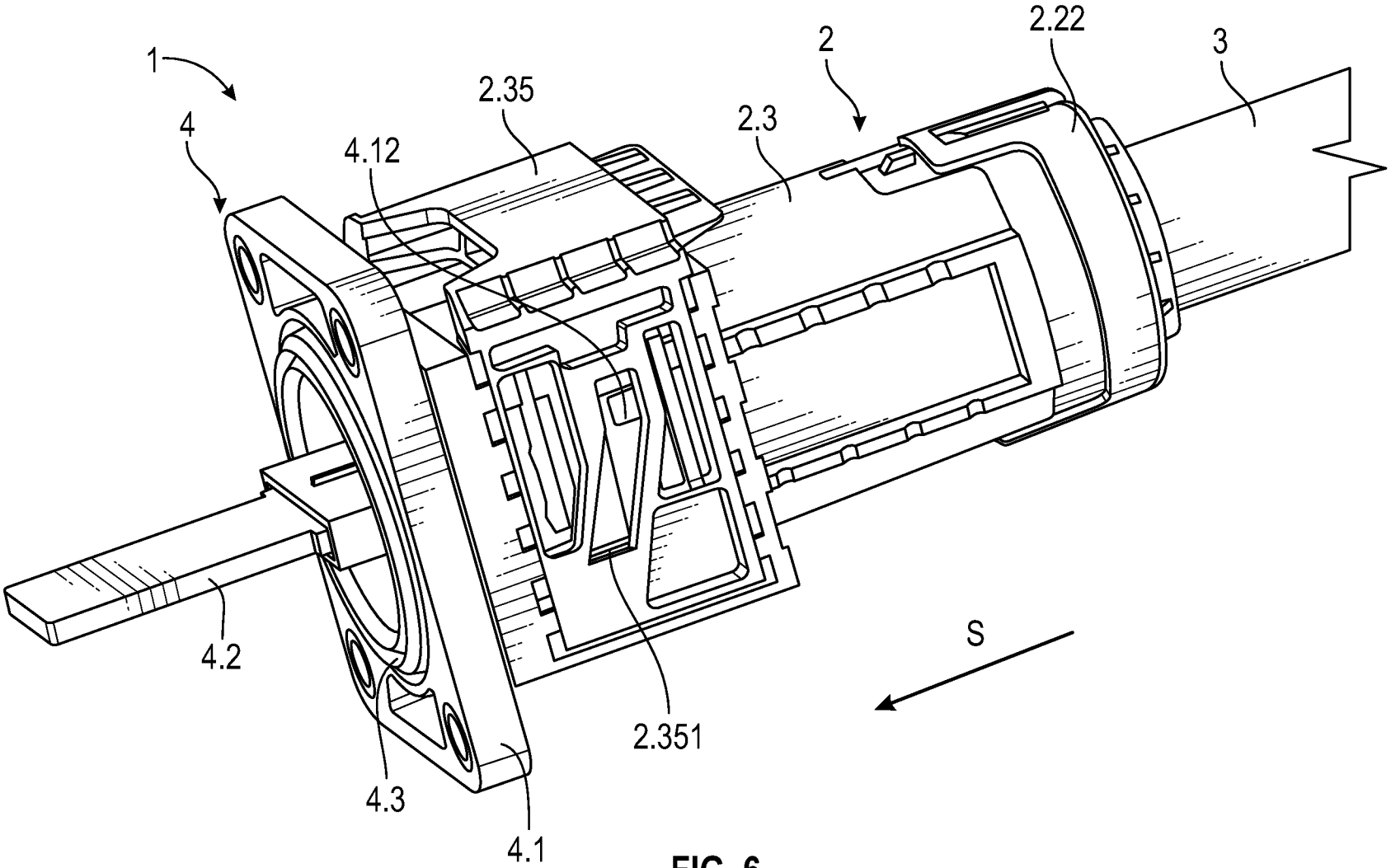
FIG. 6 a side view in perspective of a portion of the insertion-type connector, in which a fastener slide engages the header casing in order to fix the insertion-type connector and the header to one another.

FIG. 6 shows the insertion-type connection 1 now in the assembled state. In order to fix the insertion-type connector 2 on the header 4, a locking link 2.351 of the fastener slide 2.35 is in engagement with a locking element 4.12 of the header casing 4.1, as a result of which the insertion-type connector 2 is fixed on the header 4 both in and counter to the insertion direction S.

Having described aspects of the present disclosure in detail, it will be apparent that further modifications and variations are possible without departing from the scope of the present disclosure. All matter contained in the above description and shown in the accompanying drawings shall be interpreted as illustrative and not in a limiting sense.

The invention claimed is:

1. An electrical insertion-type connector configured to mate with an electrical mating contact in an insertion direction, the connector comprising:

an inner casing in which an electrical bushing contact having a locking element configured to be moved parallel to the insertion direction for setting a contact force is provided, the locking element being configured to be fixed to the mating contact, the inner casing configured to be inserted into the bushing contact in such a manner that at least one axial end of the locking element protrudes laterally out of the inner casing perpendicular to the insertion direction;

an outer casing configured to accommodate the inner casing;

a locking element fixation configured to be fixed on the outer casing in a stationary manner against movement parallel to the insertion direction and also to engage the at least one axial end of the locking element, thereby allowing a movement of the inner casing relative to the outer casing parallel to the insertion direction; and wherein the outer casing includes a locking element fixation guide, in which the locking element fixation is configured to be guided, perpendicular to the insertion direction, and fixed in the insertion direction.

2. The connector of claim 1, wherein the locking element fixation comprises a substantially U-shaped element including two opposed retaining arms, of which at least one includes an engagement groove, the engagement groove extending perpendicular to the insertion direction for accommodating engagement of the at least one axial end of the locking element.

3. The connector of claim 2, wherein the engagement groove is formed by a first retaining arm portion and a second retaining arm portion, the second retaining arm portion facing away from the mating contact in the insertion direction being shorter than the first retaining arm portion.

4. The connector of claim 2, wherein the retaining arms include a detent element on a side oriented toward the inner casing, the detent element configured be put into engagement with at least one mating detent element of the outer casing.

5. The connector of claim 1, wherein the outer casing includes at least one first mating detent element associated with a pre-detent position of the locking element fixation, and at least one second mating detent element spaced apart from the at least one first mating detent element perpendicularly to the insertion direction and associated with a final detent position of the locking element fixation, for entering into engagement with the locking element fixing fixation.

6. The connector of claim 5, wherein in the pre-detent position of the locking element fixation, the locking element of the bushing contact is movable in the insertion direction past a free end of the second retaining arm portion and is configured to be brought into engagement with the first retaining arm portion.

7. The connector of claim 5, wherein in the final detent position of the locking element fixation, both the first retaining arm portion and the second retaining arm portion are in engagement with the locking element.

8. The connector of claim 6, wherein in the final detent position of the locking element fixation, both the first retaining arm portion and the second retaining arm portion are in engagement with the locking element.

9. The connector of one of claim 1, wherein the outer casing includes one inner casing receptacle part and one header casing receptacle part surrounding the inner casing receptable part on an outside thereof perpendicular to the insertion direction.

10. The connector of claim 9, wherein the locking element fixation is located in the header casing receptacle part.

11. The connector of claim 1, wherein the outer casing includes a fastener slide displaceable perpendicular to the insertion direction and configured to be brought into engagement with a header casing of the mating contact, and upon actuation, via a guide link formed on the fastener slide, the outer casing moves relative to the inner casing or vice versa.

12. An electrical insertion-type connection comprising a connector of claim 1 and an electrical mating contact, the mating contact being inserted jointly in the connector and located in a header casing.

13. The connection of claim 12, wherein a fastener slide of the connector is brought into engagement with the header casing, and a closing motion of the fastener slide perpendicular to an insertion direction effects a relative motion between an inner casing and an outer casing of the connector in the insertion direction or parallel thereto.

* * * * *